United States Patent [19]

Yajima et al.

[11] Patent Number: 5,022,939

[45] Date of Patent: Jun. 11, 1991

[54] PERMANENT MAGNETS

[75] Inventors: Koichi Yajima, Urawa; Osamu Kohmoto, Ichikawa; Tetsuhito Yoneyama, Narashino, all of Japan

[73] Assignee: TDK Corporation, Tokyo, Japan

[21] Appl. No.: 346,457

[22] Filed: May 2, 1989

[30] Foreign Application Priority Data

| | | | |
|---|---|---|---|
| Jul. 30, 1987 | [JP] | Japan | 62-191380 |
| Oct. 14, 1987 | [JP] | Japan | 62-259373 |
| Jan. 30, 1989 | [JP] | Japan | 1-20093 |
| Jan. 30, 1989 | [JP] | Japan | 1-20094 |

[51] Int. Cl.[5] ..... H01F 1/053

[52] U.S. Cl. ..... 148/302; 420/83; 420/121; 252/62.53

[58] Field of Search ..... 148/302; 420/83, 121; 252/62.53

[56] References Cited

U.S. PATENT DOCUMENTS 4,802,931 2/1989 Croat ..... 148/302

FOREIGN PATENT DOCUMENTS 0106948 5/1984 European Pat. Off. ..... 148/302
0187538 7/1986 European Pat. Off. ..... 148/302
0197712 10/1986 European Pat. Off. ..... 148/302

OTHER PUBLICATIONS

*Journal of Less-Common Metals,* 115 (1986), pp. 357-366, "Phase Relationships, Magnetic and Crystallographic Properties of Nd-Fe-B Alloys", K. H. J. Buschow et al.

*IEEE Transaction on Magnetics,* vol. Mag-21, No. 5, Sep., 1985, pp. 1955-1957.

"Analytical Microscope Studies of Sintered Nd-Fe-B Magnets", J. Fidler et al.

J. Fidler et al, Paper No. 19P0103 at the 10th International Workshop on Rare-Earth Magnets and Their Applications, Kyoto, Japan, May 16-19, 1989.

*J. Appl. Phys.,* vol. 64, pp. 5528-5530 (1988), Nov. 15.

*Abstract,* 4th Joint MMM-Intermag Conference, Jul. 7-15, 1988.

*Primary Examiner*—John P. Sheehan

*Attorney, Agent, or Firm*—Oblon, Spivak, McClelland, Maier & Neustadt

[57] ABSTRACT

A permanent magnet material having high coercivity and energy product is provided which contains rare earth elements, boron, at least one element of Ti, V, Cr, Zr, Nb, Mo, Hf, Ta and W, optional nickel, and a balance of Fe or Fe and Co, and consists of a primary phase of substantially tetragonal grain structure, or a mixture of such a primary phase and an amorphous or crystalline rare earth element-poor auxiliary phase wherein the volume ratio of auxiliary phase to primary phase has a specific relationship to other parameters.

22 Claims, 6 Drawing Sheets

PERMANENT MAGNETS

This is a continuation-in-part application of copending application Ser. No. 225,788 filed July 29, 1988, for Permanent Magnets.

CROSS-REFERENCE TO RELATED APPLICATION

This application is related to Yajima et al., Ser. No. 38,195 filed April 14, 1987 for Permanent Magnet and Method of Producing Same.

BACKGROUND OF THE INVENTION

1. Field of the Invention

This invention relates to high performance permanent magnets used in various electric appliances. More particularly, it relates to permanent magnets in the form of rapidly quenched alloy materials of Fe-R-B and Fe-Co-R-B systems wherein R is a rare earth element.

2. Prior Art

Typical of high performance rare earth magnets are Sm-Co magnets. They are mass produced by powder metallurgy and some exhibit a maximum energy product of as high as 32 MGOe. However, Sm and Co source materials are very expensive. Those rare earth elements having a relatively low atomic mass such as cerium, praseodymium, and neodymium are supplied in more plenty and thus less expensive than samarium. To take advantage of inexpensive iron, Nd-Fe-B magnets have been recently developed. Japanese Patent Application Kokai No. 59-46008 describes sintered Nd-Fe-B magnets, and Japanese Patent Application Kokai No. 60-9852 describes rapid quenching of such magnets. The conventional powder metallurgy process for the manufacture of Sm-Co magnets can be applied to the manufacture of sintered Nd-Fe-B magnets at the sacrifice of the advantage of using inexpensive source materials. The powder metallurgy process includes a step of finely dividing a Nd-Fe alloy ingot to a size of from about 2 to about 10 $\mu$m. This step is difficult to carry out because the Nd-Fe alloy ingot is readily oxidizable. In addition, the powder metallurgy process requires a number of steps including melting, casting, rough crushing of ingot, fine crushing, pressing, and sintering until a magnet is completed.

On the other hand, the rapid quenching process is advantageous in that a magnet can be produced by a rather simple process without a fine pulverizing step. The rapid quenching process requires a smaller number of steps including melting, rapid quenching, rough crushing, and cold or hot pressing until a magnet is completed. Nevertheless, coercive force, energy product, and magnetizing behavior must be improved as well as cost reduction before rapidly quenched magnets can be commercially acceptable.

Among the properties of rare earth element-iron-boron permanent magnets, coercivity is sensitive to temperature. Rare earth element-cobalt magnets have a temperature coefficient of coercive force (iHc) of 0.15%/° C., whereas rare earth element-iron-boron magnets have a temperature coefficient of coercive force (iHc) of 0.6 to 0.7%/° C., which is at least four times higher than the former. The rare earth element-iron-boron magnets have the likelihood of demagnetizing with an increasing temperature, limiting the design of a magnetic circuit to which the magnets are applicable. In addition, this type of magnet cannot be incorporated in parts which are mounted in an engine room of automobiles used in the tropics.

As is known in the prior art, a high temperature coefficient of coercive force creates a bar when it is desired to commercially use rare earth element-iron-boron permanent magnets. There is a need for development of a magnet having a great magnitude of coercive force (see Nikkei New Material, 4-28, No. 9 (1986), page 80).

Japanese Patent Application Kokai No. 60-9852 or Croat, EPA 0108474 describes how to impart high values of coercive force (iHc) and energy product to R-Fe-B alloy by rapid quenching. The composition is claimed as comprising at least 10% of rare earth element of Nd or Pr, 0.5 to 10% of B, and a balance of Fe. It was believed that the outstanding magnetic properties of R-Fe-B alloy were attributable to the $Nd_2Fe_{14}B$ compound-phase. Accordingly, regardless of whether the method is by sintering or by rapid cooling, most prior art proposals for improving magnetic properties were based on experiments using materials having a composition in proximity to the above compound, i.e., 12–17% of R and 5–8% of B (see Japanese Patent Application Kokai Nos. 59-89401, 60-144906, 61-79749, 57-41901, and 61-73861).

Since the rare earth elements are expensive, it is desired to reduce their content as low as possible. Unfortunately, coercive force (iHc) is dramatically reduced at a rare earth element content of less than 12%. As indicated in FIGS. 11 and 12 of EPA 0108474, iHc is reduced to 6 kOe or less at a rare earth element content of 10% or less. Although it is known for R-Fe-B alloys that coercivity is reduced at a rare earth element content of less than 12%, no method is known for controlling the composition and structure of an R-Fe-B alloy so as to optimize magnetic properties while preventing coercivity from decreasing.

Although $Nd_2Fe_{14}B$ compound is used as the basic compound in both the sintering method and the rapid quenching method, the magnets produced by these methods are not only different in the production method, but also belong to essentially different types of magnet with respect to alloy structure and coercivity-generating mechanism, as described in Oyobuturi (Applied Physics), Vol. 55, No. 2 (1986), page 121. More particularly, the sintered R-Fe-B ;magnet has a grain size of approximately 10 $\mu$m and is one of the nucleation type as observed with $SmCo_5$ magnet in which coercivity depends on the nucleation of inverse magnetic domains, if compared to conventional Sm-Co magnets. On the contrary, the rapidly quenched magnet is of the pinning type as observed with $Sm_2Co_{17}$ magnet in which coercivity depends on the pinning of magnetic domain walls due to the extremely fine structure of fine particles of from 0.01 to 1 $\mu$m in size being surrounded by an amorphous phase which is richer in Nd than $Nd_2Fe_{14}B$ compound (see J. Appl. Phys., 62(3), Vol. 1 (1987), pages 967–971). Thus any approach for improving the properties of these two types of magnets must first take into account the difference of coercivity-generating mechanism.

We have proposed in Japanese Patent Application No. 62-90709 a permanent magnet having a composition of $R_xT(100\text{-}x\text{-}y\text{-}z)ByMz$ wherein $5.5 \leqq x \leqq 20.0$ and R, T, y and z have similar meanings as defined in the present disclosure, having a fine crystalline phase or a mixture of a fine crystalline phase and an amorphous phase. This magnet is still not fully satisfactory.

SUMMARY OF THE INVENTION

An object of the present invention is to provide a permanent magnet material exhibiting a high coercive force, a high energy product, improved magnetization, high corrosion resistance, and stable performance.

Another object of the present invention is to provide such a permanent magnet material exhibiting outstandingly high corrosion resistance.

According to the present invention, there is provided a permanent magnet material having a composition represented by the formula:

$$R_xT(100\text{-}x\text{-}y\text{-}z\text{-}w)B_yM_zNi_w$$

wherein R is at least one member selected from the rare earth elements including Y, T is Fe or a mixture of Fe and Co, M is at least one member selected from the group consisting of titanium (Ti), vanadium (V), chromium (Cr), zirconium (Zr), niobium (Nb), molybdenum (Mo), hafnium (Hf), tantalum (Ta), and tungsten (W), B is boron, Ni is nickel, letters x, y, z, and w represent atom percents of the corresponding elements and have positive values with the proviso that w can be equal to zero, $$5.5 \leqq x < 11.76,$$

$$2 \leqq y < 15,$$

$$0 < z \leqq 15, \text{ and}$$

$$0 < z + w \leqq 30.$$

The permanent magnet material consists essentially of a primary phase of substantially tetragonal grain structure, or a primary phase of substantially tetragonal grain structure and at least one R-poor auxiliary phase selected from amorphous and crystalline R-poor auxiliary phases.

BRIEF DESCRIPTION OF THE DRAWINGS

The above and other objects, features, and advantages of the present invention will be more readily understood from the following description when taken in conjunction with the accompanying drawings, in which.

DETAILED DESCRIPTION OF THE INVENTION

Figure 1:
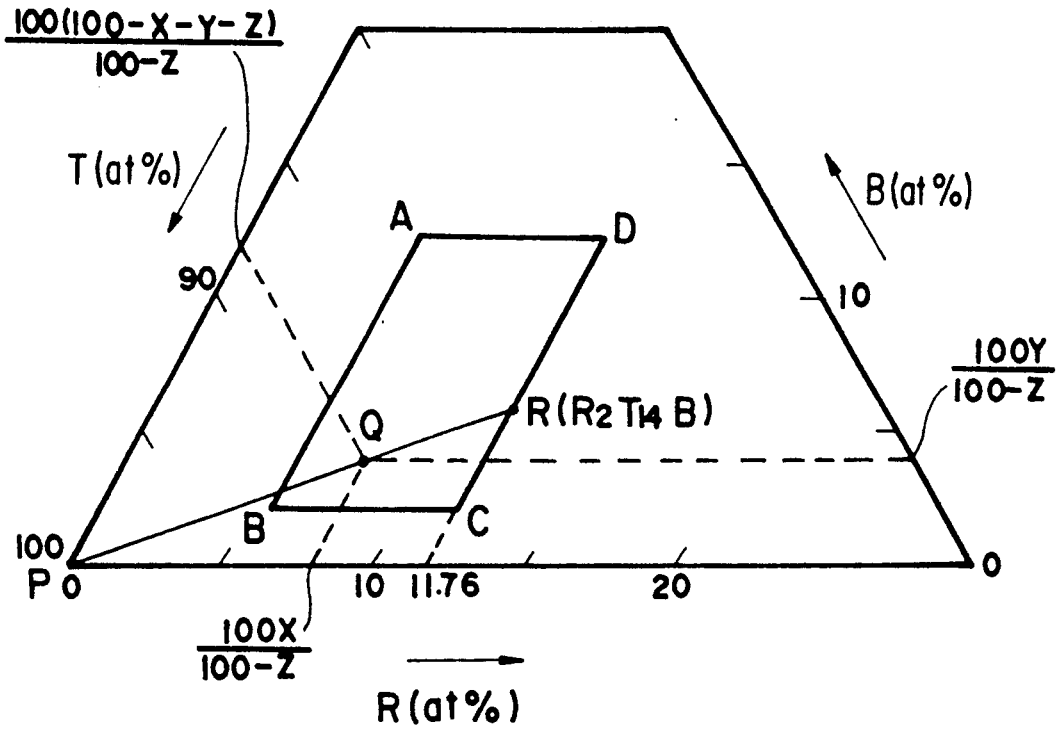
FIG. 1 is a ternary diagram showing the composition of the permanent magnet according to the present invention.

Briefly stated, the permanent magnet material according to the first aspect of the present invention has a composition represented by the formula:

$$R_xT(100\text{-}x\text{-}y\text{-}z\text{-}w)B_yM_zNi_w$$

wherein R is at least one member selected from the rare earth elements including yttrium (Y); T is iron (Fe) or a mixture of iron (Fe) and cobalt (Co); M is at least one member selected from the group consisting of titanium (Ti), vanadium (V), chromium (Cr), zirconium (Zr), niobium (Nb), molybdenum (Mo), hafnium (Hf), tantalum (Ta), and tungsten (W); B is boron; and Ni is nickel.

Letters x, y, z, and w represent atom percents of the corresponding elements and have positive values with the proviso that w can be equal to zero, $$5.5 \leqq x < 11.76,\ 2 \leqq y < 15,\ 0 < z \leqq 15, \text{ and } 0 < z + w \leqq 30.$$

More particularly, R is at least one member selected from the rare earth elements including yttrium (Y). Preferably, R is represented by the formula:

$$R'_a(Ce_bLa_{1\text{-}b})_{1\text{-}a}$$

wherein R' is at least one member selected from the rare earth elements including yttrium (Y), but excluding cerium (Ce) and lanthanum (La), $$0.80 \leqq a \leqq 1.00 \text{ and } 0 \leqq b \leqq 1.$$

Inclusion of Ce and La is recommended for cost reduction.

In the above-defined composition, the quantity x of rare earth element R ranges from 5.5 to less than 11.76. With x of less than 5.5, the magnet tends to show a low coercive force iHc. With x of 11.76 or higher, remanence Br is drastically lowered. Better results are obtained when x ranges from 5.5 to 11. Magnet materials having relatively high corrosion resistance are available at a relatively low cost when x ranges from 5.5 to 8.

When the value of (1-a) exceeds 0.2, maximum energy product becomes lower. R' may further contain samarium (Sm) provided that the quantity of samarium is up to 20% of the quantity x of rare earth element R. Otherwise there results a low anisotropic constant.

Most preferably, R is selected from neodymium (Nd), praseodymium (Pr), dysprosium (Dy), and mixtures thereof.

The quantity y of boron B ranges from 2 to less than 15. Coercive force iHc is low with a value of y of less than 2, whereas remanence Br is low with a value of y of 15 or higher. Better results are obtained when y ranges from 2 to 14.

When up to 50% of B is replaced by Si, C, Ga, Al, P, N, Se or S, or a mixture thereof, there is available an effect similar to the addition of B alone. Inclusion of phosphorus (P) is effective in improving corrosion resistance. Preferably, P is included as a boron substitute in an amount of 0.001 to 3%, more preferably 0.01 to 2% of B.

In addition, oxygen (0) may be included up to 1 wt %. Hydrogen (H) may be included in a small amount.

T may be either iron (Fe) alone or a mixture of iron (Fe) and cobalt (Co). Partial replacement of Fe by Co improves the magnetic performance and Curie temperature of the magnet. Provided that T is represented by $Fe_{1\text{-}c}Co_c$, the replacement quantity c should preferably range from 0 to 0.7 because coercive force becomes low with a value of c in excess of 0.7.

M is at least one member selected from the group consisting of titanium (Ti), vanadium (V), chromium (Cr), zirconium (Zr), niobium (Nb), molybdenum (Mo), hafnium (Hf), tantalum (Ta), and tungsten (W). Since the addition of element M controls grain growth, the coercive force of a magnet material is maintained high even when it is processed at high temperatures for a long time.

The quantity z of element M should be up to 15 because magnetization is drastically reduced with a value of z in excess of 15. Preferably z is up to 10. A value of z of at least 0.1 is preferred to increase coercive force iHc. A value of z of at least 0.5, especially at least 1 is preferred to increase corrosion resistance. The addition of more than one element M is more effective in increasing coercive force iHc than the addition of element M alone. When a mixture of two or more elements M is added, the maximum quantity of the elements combined is 15%, preferably 10% as described above.

Part of element M may be replaced by at least one member selected from the group consisting of copper (Cu), manganese (Mn), and silver (Ag). The addition of Cu, Mn or Ag facilitates the plastic processing of magnet material without deteriorating the magnetic properties thereof. Assumed that M1 represents at least one member selected from the group consisting of Ti, V, Cr, Zr, Nb, Mo, Hf, Ta and W and M2 represents at least one member selected from the group consisting of Cu, Mn and Ag, the ratio of M1:M2 preferably ranges from 2:1 to 10:1, more preferably from 3:1 to 5:1. Within this range, the plastic processability of magnet material is improved without sacrificing remanence and coercive force.

Ni, nickel is included for the purpose of improving corrosion resistance. Also the plastic processability of magnet material is improved without a loss of magnetic properties.

When nickel is present, that is, $w > 0$, it is preferred that $4 \leqq z \leqq 15$ and $4 < (z+w) \leqq 30$. Magnetiza drastically reduced beyond the upper limits. When nickel is present, the lower limit of M content (z) is preferably set at 4 atom% in order to obtain meaningful results. The preferred range for the purpose of corrosion resistance improvement is $0.1 \leqq w \leqq 26$, especially $0.5 \leqq w \leqq 26$. For enhanced effect, the preferred range is $2 \leqq w \leqq 21$, more preferably $2.5 \leqq w \leqq 21$, and most preferably $5 \leqq w \leqq 20$.

It should be noted that in all cases, the value of formula: $[0.1176(100-z)-x]$ is positive, that is, $[0.1176(100-z)-x] > 0$.

To obtain a magnet having a high coercive force, it is preferred that x range from 7 to 11, more preferably from 8 to 10, y range from 2 to less than 15, more preferably from 4 to 2, most preferably from 4 to 10, c range from 0 to 0.7, more preferably from 0 to 0.6, and z range from 0.1 to 10, more preferably from 2 to 10.

To obtain an isotropic magnet having a high energy product, it is preferred that x range up to less than 11, more preferably up to less than 10, y range from 2 to less than 15, more preferably from 4 to 12, most preferably from 4 to 10, c range from 0 to 0.7, more preferably from 0 to 0.6, and z range from more than 0 to 10, more preferably from 2 to 10.

To obtain an isotropic, readily magnetizable magnet having a high energy product, it is preferred that x range from 6 to 11, more preferably from 6 to less than 10, y range from 2 to less than 15, more preferably from 4 to 12, most preferably from 4 to 10, c range from 0 to 0.7, more preferably from 0 to 0.6, and z range from more than 0 to 10, more preferably from 2 to 10.

To obtain an anisotropic magnet having a high energy product, it is preferred that x range from 6 to 11.76, y range from 2 to less than 15, more preferably from 4 to 12, most preferably from 4 to 10, c range from 0 to 0.7, more preferably from 0 to 0.6, and z range from more than 0 to 10, more preferably from 2 to 10.

In these preferred examples, when nickel is present, the preferred ranges of z and w are as previously described.

The composition of the magnet material may be readily determined by atomic-absorption spectroscopy, fluorescent X-ray spectroscopy or gas analysis.

The permanent magnet material of the present invention consists essentially of a primary or major phase of substantially tetragonal grain structure, or a primary or major phase of substantially tetragonal grain structure and at least one auxiliary or minor R-poor phase selected from amorphous and crystalline R-poor auxiliary phases. In the latter case, if the auxiliary phase has the same R content as or is R richer than the primary phase, remanence Br is low and less corrosion resistance is expectable. It is thus critical that the auxiliary phase be R poor.

Where the permanent magnet material consists essentially of primary and auxiliary phases, the volume ratio of auxiliary phase to primary phase, v, is preferably at most 2 times the stoichiometric ratio of auxiliary phase to primary phase occurring upon quasi-static cooling of a melt having the same composition which is given by the formula: $(11.76-x)/x$. That is, $$\frac{v}{(11.76-x)/x} \leqq 2$$

Also preferably, the volume ratio of auxiliary phase to primary phase, v, is preferably at most 2 times the stoichiometric ratio of auxiliary phase to primary phase occurring upon quasi-static cooling of a melt having the same composition which is given by the formula: $[0.1176(100-z)-x]/x$. That is, $$\frac{v}{[0.1176(100-z)-x]/x} \leqq 2$$

Figure 2:
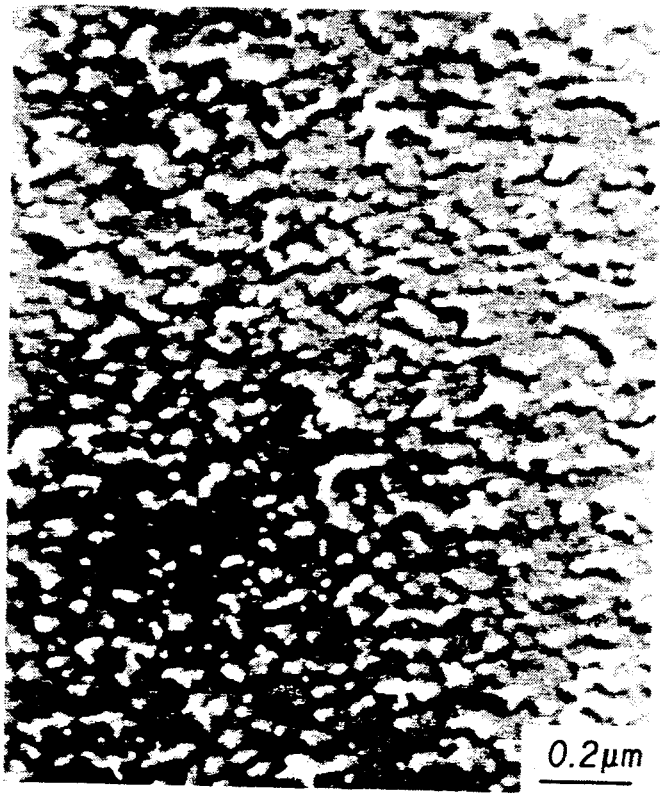
FIGS. 2 and 3 are electron photomicrographs of X50,000 and X200,000 showing the grain structure of permanent magnet sample No. 3 of Example 1.
Figure 3:
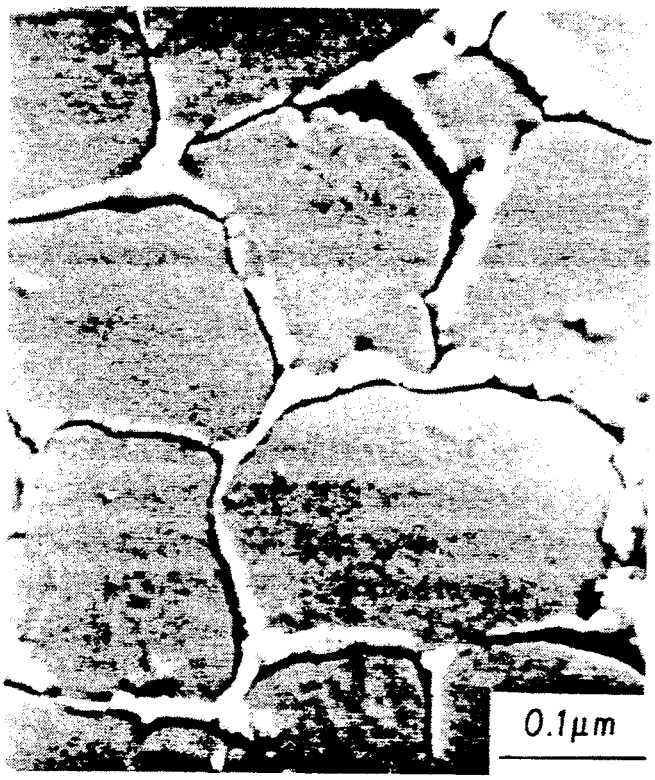

The volume ratio of auxiliary phase to primary phase, v, may be determined by an observation under an electron microscope. More particularly, the volume ratio is determined by observing a sample under a scanning electron microscope (SEM) with a magnifying power of X10,000 to X200,000, sampling out about 5 to 10 visual fields at random, subjecting them to image information processing or mapping, separating primary phase areas from auxiliary phase areas in terms of gradation, and calculating the ratio of the areas. FIGS. 2 and 3 are scanning electron photomicrographs of a sample with a magnification of X50,000 and X200,000, respectively, which are used for the purpose.

To determine the volume ratio, a transition electron microscope (TEM) can be used in place of SEM.

The stoichiometric ratio of auxiliary phase to primary phase may be derived as follows. Among R-T-B compounds, a stable tetragonal compound is represented by $R_2T_{14}B$ wherein R =11.76 at %, T=82.36 at %, and B=5.88 at %. According to the present invention, the primary phase has a substantially tetragonal grain structure and the auxiliary phase has a R-poor composition.

FIG. 1 shows a ternary phase diagram of an R-T-B system in which $R_2T_{14}B$ is designated at R (11.76, 82.36, 5.88). The area defined and surrounded by ABCD in the diagram of FIG. 1 is the range of R-T-B composition of the magnet material according to the present invention excluding element M. It is assumed for brevity of description that nickel is absent, that is, w=0.

It is now assumed in the ternary diagram of FIG. 1 that a composition falling within the scope of the present invention is designated at point Q having coordinates, $R=100x/(100-z)$, $B=100y/(100-z)$, and $T=100(100-x-y-z)/(100-z)$. When a melt having the composition of point Q is quasi-statically cooled from the melting point, the melt is separated into two phases, R ($R_2T_{14}B$) and P (T). For stoichiometric calculation, the atomic ratio of T/R2T14B is equal to QR/PQ. Then, QR/PQ is calculated as follows.

$$\begin{aligned} QR/PQ &= Q'R'/PQ' \\ &= [11.76 - 100x/(100 - z)]/[100x/(100 - z)] \\ &= [0.1176(100 - z) - x]/x. \end{aligned}$$

According to the present invention, the auxiliary-to-primary phase ratio v ranges from 0 to 2 times the value given by $[0.1176(100-z)-x/x$, that is, $$0 \leqq v < 2[0.1176(100-z)-x]/x.$$

The auxiliary-to-primary phase ratio V is limited to this range because (B.H)max is reduced and iHc is markedly reduced outside the range. The quotient A of auxiliary-to-primary phase ratio v divided by $[0.1176(100-z)-x]/x$ is generally up to 2, preferably less than 1.5, more preferably less than 1.2. Especially quotient A is less than 1.0, more preferably in the range of from 0.15 to 0.95, most preferably from 0.3 to 0.8. In the above-defined range, not only coercive force iHc and remanence are stable and high, but also squareness ratio Hk/iHc is increased. As a result, maximum energy product (BH)max is further increased.

Quotient A may be controlled to fall within the range by rapidly quenching magnet material. Preferred rapid quenching is melt spinning as will be later described in detail. Usually single roll melt spinning is employed. More specifically, the circumferential speed of a rotating chill roll is controlled to 2 to 50 m/sec., more preferably to 5 to 35 m/sec. There is some likelihood that at a circumferential speed of less than 2 m/sec., most of the resulting thin ribbon has crystallized to an average grain size as large as at least 3 μm. The value of quotient A becomes too high at a circumferential speed of more than 50 m/sec. Better properties including higher values of coercive force and energy product are achieved by controlling the circumferential speed within the preferred range.

According to the present invention, it is also possible to control the value of quotient A to the desired range by rapid quenching followed by a heat treatment. In this case, the circumferential speed of a rotating chill roll used in single roll melt spinning is controlled to 10 to 70 m/sec., more preferably to 20 to 50 m/sec. There is some likelihood that at a circumferential speed of less than 10 m/sec., most of the resulting thin ribbon has crystallized to such an extent that no crystallization or crystal growth of amorphous portions is necessary in the subsequent heat treatment. The value of quotient A becomes too high at a circumferential speed of more than 70 m/sec. The heat treatment used herein may be annealing in an inert atmosphere or vacuum at a temperature of from 400 to 850° C. for about 0.01 to about 100 hours. The inert atmosphere or vacuum is used in the heat treatment to prevent oxidation of the ribbon. No crystallization or crystal growth takes place at a temperature of lower than 400° C. whereas quotient A will have a value of more than 2 at a temperature of higher than 850° C. Shorter than 0.01 hour of heat treatment will be less effective whereas longer than 100 hours of heat treatment achieves no further improvement and is only an economic waste.

The present invention does not necessarily require heat treatment as described above. The process without heat treatment is more simple.

In one embodiment, the permanent magnet material of the present invention consists of a primary phase having a substantially tetragonal grain structure. This primary phase is a metastable $R_2T_{14}B$ phase with which M forms an oversaturated solid solution and which preferably has an average grain size of 0.01 to 3 μm, more preferably 0.01 to 1 μm, most preferably 0.01 to 0.3 μm. The grain size is preferably chosen in this range because grains with a size of less than 0.01 μm are incomplete and produce little coercive force iHc whereas the coercive force is rather reduced with grains having a size of more than 3 μm.

In a preferred embodiment, the permanent magnet material of the present invention consists of a primary phase as defined above and an amorphous and/or crystalline R-poor auxiliary phase. The auxiliary phase is present as a grain boundary layer around the primary phase. The R-poor auxiliary phase includes amorphous and crystalline phases of α-Fe, Fe-M-B, Fe-B, Fe-M and M-B systems. Where Ni is included, Fe-M-Ni-B, Fe-M-Ni and M-Ni-B systems are contemplated.

It is preferred that the R content of the auxiliary phase is up to 9/10, more preferably up to ⅔, most preferably from 0 to ⅔ of that of the primary phase in atomic ratio. Most preferably, the atomic ratio of R content of the auxiliary phase to the primary phase (Ra/Rp) is up to ½, especially from more than 0 to ½. Beyond the upper limit of 9/10, despite an increase of coercive force, remanence and hence, maximum energy product are lowered.

The composition of the primary and auxiliary phases may be determined by a transmission type analytic electron microscope. It sometimes occurs that an auxiliary phase has smaller dimensions than the diameter of an electron radiation beam which normally ranges from 5 to 20 nm. In such a case, the influence of ingredients of the primary phase must be taken into account.

The auxiliary phase has the following contents of the elements other than R. Expressed in atomic ratio, the content of T is $0 \leqq T \leqq 100$, more preferably $0 < T < 100$, most preferably $20 \leqq T \leqq 90$, the content of boron B is $0 \leqq B \leqq 60$, more preferably $0 < B \leqq 60$, most preferably $10 \leqq B \leqq 50$, and the content of M is $0 \leqq M \leqq 50$, more preferably $0 < M \leqq 50$, most preferably $10 \leqq M \leqq 40$ ($0 \leqq M+Ni \leqq 50$, more preferably $0 < M+Ni \leqq 50$, most preferably $10 \leqq M+Ni \leqq 40$ when Ni is present). Within this composition range, magnetic properties including coercive force iHc, remanence Br and maximum energy product (BH)max are improved.

To increase the coercive force of magnet material, the content of T in the auxiliary phase is $0 \leqq T \leqq 60$, more preferably $0 < T \leqq 60$, most preferably $10 \leqq T \leqq 50$, the content of B is $10 \leqq B \leqq 60$, more preferably $20 \leqq B \leqq 50$, and the content of M is $10 \leqq M \leqq 50$, more preferably $20 \leqq M \leqq 40$ ($10 \leqq M+Ni \leqq 50$, more preferably $20 \leqq M+Ni \leqq 40$ when Ni is present). To increase the remanence of magnet material, the content of T in the auxiliary phase is $60 \leqq T < 100$, more preferably $70 \leqq T \leqq 90$, the content of B is $0 < B \leqq 30$, more preferably $0 < B \leqq 20$, and the content of M is $0 < M \leqq 30$, more preferably $0 < M \leqq 20$ ($0 < M+Ni \leqq 30$, more preferably $0 < M+Ni \leqq 20$ when Ni is present).

In this embodiment, the primary phase preferably has a content of R and M combined of from 11 to 12 atom %. Outside this range, it is difficult for the primary phase to maintain a tetragonal structure.

It is preferred that the primary phase has a content of R of from 6 to 11.76 atom %, more preferably from 8 to 11.76 atom %. Coercive force is substantially reduced with an R content of less than 6 atom% whereas an R content of more than 11.76 atom % results in a reduction of remanence and maximum energy product despite an increase of coercive force.

It is preferred that the content of T in the primary phase is $60 \leqq T \leqq 85$, more preferably $62 \leqq T \leqq 83$ and the content of B is $4 \leqq B \leqq 7$, more preferably $5 \leqq B \leqq 6$. Within this range, a magnet material having a high energy product is obtained in spite of a low content of rare earth element.

The composition of the primary and auxiliary phases may be determined by a transmission type electron microscope for analysis.

The auxiliary phase constituting a grain boundary layer preferably has an average breadth of up to 0.3 μm, more preferably from 0.001 to 0.2 μm. A grain boundary layer having a breadth of more than 0.3 μm will result in a low coercive force iHc.

The permanent magnet of the present invention is generally prepared by the so-called melt spinning method, that is, by quenching and solidifying molten Fe-R-B or Fe-Co-R-B alloy having a composition within the above-defined range at a high cooling rate.

The melt spinning method is by ejecting molten alloy through a nozzle onto the surface of a rotary metal chill roll cooled with or without water or another coolant, obtaining a magnet material in ribbon form. Melt spinning may be carried out with a disk, a single roll or double rolls. Most preferred for the present invention is a single roll melt spinning method comprising ejecting molten alloy onto the circumferential surface of a rotating single roll. A magnet having a coercive force iHc of up to about 20,000 Oe and a magnetization of 65 to 150 emu/gr may be prepared by rapidly quenching and solidifying molten alloy of the above-defined composition by the single roll melt spinning method while controlling the circumferential speed of the roll within the above-defined range. The roll can consist of Cu, Cu-Be alloy, Cr plated Cu or Cu-Be, quenched steel, stainless steel or the like.

In addition to the melt spinning method using a roll, various other rapid quenching methods including atomizing and spraying and a mechanical alloying method may also be applied to the present invention.

The magnets thus prepared have a good temperature coefficient of their magnetic properties. More particularly, the magnets have the following coefficients of remanence (Br) and coercive force (iHc) with temperature (T):

$$dBr/dT = -0.09 \text{ to } -0.06\%/^\circ C.$$

$$diHc/dT = -0.48 \text{ to } -0.25\%/^\circ C.$$

over the temperature range of $20^\circ C. \leqq T \leqq 120^\circ C.$, for example.

Since a very fine grained crystalline structure or a structure consisting of a very fine grained crystalline primary phase and a crystalline and/or amorphous auxiliary phase is formed by quenching and solidifying directly from a molten alloy, the resulting magnet exhibits excellent magnetic properties as described above.

A thin film obtained in ribbon form generally has a thickness of about 20 to about 80 μm. It is preferred to form a ribbon to a thickness of from 20 to 60 μm, because the distribution of grain size in film thickness direction and hence, the variation of magnetic properties due to varying grain size is minimized. Then the average values of magnetic properties are increased.

The structure obtained after quenching, which will vary with quenching conditions, consists of a fine grained crystal structure or a mixture of a fine grained crystal structure and an amorphous structure. If desired, this fine crystalline or fine crystalline-amorphous structure as well as its size may be further controlled so as to provide more improved properties by a subsequent heat treatment or annealing.

The magnet which is quenched and frozen by the melt spinning method may be heat treated or annealed as described above. The annealing heat treatment is effective for the quenched magnet of the composition defined by the present invention to more closely fulfil the above-mentioned requirements and to exhibit more stable properties more consistently.

In general, a permanent magnet is prepared by finely dividing the permanent magnet material thus prepared in ribbon form into powder. The size of such finely divided permanent magnet material or particles depends on a particular application form such as a bulk or bonded magnet and is not particularly limited. The permanent magnet material is generally ground into particles having a particle size of about 10 to 500 μm, preferably about 20 to 300 μm.

According to the present invention, the permanent magnet material particles have M or M plus Ni present on their surface, forming a corrosion resistant layer. The content of M on the particle surface is higher than the average content of M (z) of the entire particle, preferably at least 1.5 times, more preferably at least 2 times, most preferably at least 5 times the average content of M (z) of the entire particle. The presence of M or M plus Ni on the particle surface may be measured by Auger spectroscopy or similar spectroscopy, and the thickness of the corrosion resistant layer formed thereby may be measured by Auger spectroscopy with etching.

A bulk magnet having a high density may be prepared by pulverizing a ribbon magnet to a particle size of about 10 to 500 μm, preferably about 20 to 300 μm and cold or hot pressing the resulting powder into a compact of a suitable density.

A bonded magnet may be obtained from the permanent magnet of the present invention by a powder bonding method. More particularly, a ribbon magnet obtained by the melt spinning method or a powder thereof is annealed and again pulverized if desired, and then mixed with a resinous binder or another suitable binder. The mixture of magnet powder and binder is then compacted into a bonded magnet.

Well-known isotropic bonded magnets have a maximum energy product of at most about 10 MGOe (mega-Gauss Oersted). In contrast, a bonded magnet having a maximum energy product of more than 10 MGOe can be produced according to the present invention by controlling the manufacturing parameters such that the magnet has a quotient A of up to 2, most preferably from 0.15 to 0.95 and a density of more than 6 g/cm$^3$.

Ribbon magnets obtained by the melt spinning method are disclosed in Japanese Patent Application Kokai No. 59-211549 as well as bulk magnets obtained by compacting pulverized ribbon powder and bonded magnets obtained by compacting pulverized ribbon powder with binder. In order to magnetize conventional magnets to saturation magnetization, a magnetizing field of as high as 40 kOe to 110 kOe must be applied as described in J.A.P., 60(10), vol. 15 (1986), page 3685. In contrast, the magnet alloys of the present invention containing Zr, Ti or another element M have an advantage that they can be magnetized to saturation magnetization by applying a magnetizing field of 15 kOe to 20 kOe. Differently stated, the magnets of the present invention show significantly improved magnetic properties after magnetization under a field of 15 to 20 kOe.

Plastic processing of ribbon magnet obtained by the melt spinning method or magnet powder obtained by pulverizing ribbon magnet will result in an anisotropic magnet having a higher density whose magnetic properties are improved by a factor of two or three. The temperature and time conditions under which plastic processing is carried out should be chosen so as to establish a finely crystalline phase as described in conjunction with annealing while preventing the formation of coarse grains. In this respect, the inclusion of additive element M such as Nb, Zr, Ti and V has an advantage of mitigating hot plastic processing conditions. Since additive element M controls grain growth during hot plastic processing, the magnet can maintain a high coercive force even after an extended period of processing at elevated temperatures.

Plastic processing may include hot pressing, extrusion, rolling, swaging, and forging. Hot pressing and extrusion will give optimum magnetic properties. Hot pressing is preferably carried out at a temperature of 550 to 1,100° C under a pressure of 200 to 5,000 kg/cm$^2$. Primary hot pressing will suffice although primary hot pressing followed by secondary hot pressing will further improve magnetic properties. Extrusion molding is preferably carried out at a temperature of 500 to 1,100° C. under a pressure of 400 to 20,000 kg/cm$^2$.

The magnet which is rendered anisotropic by such plastic processing may also be used in the form of bonded magnet.

In the practice of the present invention, not only the melt spinning method is used, but a hot processing method such as hot pressing may also be used insofar as processing conditions are selected so as to achieve grain size control. The magnet of the present invention can be readily prepared by hot pressing because the inclusion of element M dulls the sensitivity in grain growth of the magnet to temperature and time conditions.

Now, the bonded magnet in one form of the present invention is described in more detail. The bonded magnet according to the invention includes the permanent magnet material powder as prepared above and a binder for bonding the powder. A lubricant is also included which is selected from powder materials having a laminar crystalline structure, higher fatty acids and salts thereof, and mixtures thereof.

The powder materials having a laminar crystalline structure cover the permanent magnet material particles and impart good flow since they are liable to deform upon molding. The powder materials having a laminar crystalline structure are not particularly limited although molybdenum disulfide $MoS_2$, graphite and boron nitride BN and a mixture thereof are preferred because of their heat resistance. Molybdenum sulfide $MoS_2$ and graphite are most preferred. As to the shape, the powder materials having a laminar crystalline structure are preferably particles of a flat shape having a laminar plane as a major surface. Flat particles readily mix with magnet material particles and fully cover the surface of the latter, resulting in a mixture with smooth flow.

To enhance the flow of magnet material particles, the particulate material having a laminar crystalline structure to be blended therewith has the following preferred dimensions. The average particle size is from about 0.1 to 10 μm, more preferably from about 0.3 to 4 μm as measured by a particle size distribution measurement based on optical diffraction. The average thickness of the particulate material is from about 0.03 to 1 μm, more preferably from about 0.05 to 0.6 μm. The aspect ratio, defined as the average breadth on the major surface divided by the average thickness, is from about 3 to 50, more preferably from about 5 to 20. A scanning electronmicroscope is convenient for major surface determination and average diameter and thickness measurements.

In the bonded magnet, the particulate material having a laminar crystalline structure is contained in an amount of 0.001 to 10%, more preferably 0.02 to 2% by weight based on the weight of the permanent magnet material. More than 10 wt % of such particulate material results in a composition which contains permanent magnet particles in a low packing density and thus exhibits low magnetic properties.

The higher fatty acids include stearic acid, carnauba wax, montan wax, amide wax, paraffin wax, etc., with stearic acid being preferred. Their salts are metal salts, typically zinc salts. The higher fatty acids are generally available in the form of agglomerates preferably having a particle size of about 2 to 50 μm, especially about 5 to 15 μm. The preferred content of the higher fatty acids and their salts is the same as described for the particulate material having a laminar crystalline structure.

In addition to the permanent magnet particles, binder and lubricant, the bonded magnet of the invention may contain any other additive such as a coupling agent, plasticizer, and antioxidant if desired.

The permanent magnet particles used herein preferably have an average particle size of about 20 to 300 μm, more preferably about 60 to 280 μm. The average particle size may be determined from measurements on a photomicrograph taken through a scanning electronmicroscope (SEM). Measurement is preferably taken on at least 400 particles.

The binder used herein is not particularly limited. Thermosetting resin compositions commonly used in conventional bonded magnets may be used, for example, a composition of an epoxy resin and a curing agent. The form of the binder during mixing is not limitative.

The mixing method is not limitative. Any conventional well-known mixing devices may be used, for example, horizontal rotating cylinder mixers, cubic mixers, vertical double cone mixers, twin shell tumblers, blade mixers, helical mixers, ribbon mixers, and impact rotation mixers.

A bonded magnet is prepared from a composition of permanent magnet particles, binder and lubricant by press - molding it under a pressure of about 2 to 10 t/cm$^2$ for about ½ to 10 seconds. Press molding is followed by a heat treatment to thermoset the binder. The heat treatment may be carried out within the mold or after removal from the mold.

Since a permanent magnet is prepared by rapid quenching according to the present invention, the magnet may include not only an equilibrium phase, but also a non-equilibrium phase. Even when the magnet has an R content as low as from 5.5 atom % to less than 11.76 atom % and is isotropic, it shows high values of coercivity and energy product. It is a practical high performance permanent magnet.

In an embodiment wherein R is Nd, the addition of element M contributes particularly to an increase of coercivity when the Nd content is at least 10 atom %, and to an increase of maximum energy product (BH)max when the Nd content is reduced to less than 10 atom % for cost reduction purpose.

Additive element M greatly contributes to coercivity improvement. This tendency is observed not only with Nd, but also with the other rare earth elements. It is thought that the coercivity of the present magnet is increased because its coercivity-generating mechanism relies on a finely crystalline structure having as major phase a metastable $R_2Fe_{14}B$ phase with which element M forms an oversaturated solid solution when the R content is within the scope of the present invention, particularly less than 10 atom %, as opposed to the coercivity-generating mechanism relying on stable tetragonal $R_2Fe_{14}B$ compound which is observed with conventional R-Fe-B. In general, up to about 2 atom % of element M can form a stable solid solution at elevated temperatures. Only rapid quenching enables more than 2 atom % of element M to form a solid solution in which element M is kept metastable. For this reason, additive element M stabilizes $R_2Fe_{14}B$ phase even with a low R content. This stabilizing effect is available only by rapid quenching, but not available in sintered magnets.

Preferably, the permanent magnet of the present invention consists essentially of a finely crystalline primary phase and a crystalline and/or amorphous R-poor auxiliary phase. The auxiliary phase serves as a boundary layer to provide pinning sites, reinforcing the bonding between primary grains.

The permanent magnet of the present invention is readily magnetizable and fully resistant to corrosion. Conventional R-T-B magnets need careful rust prevention because they contain a corrodible B-rich phase or R-rich phase or both in addition to $R_2T_{14}B$ phase. In contrast, the permanent magnets of the present invention need little or simple rust prevention because they are composed of a primary phase consisting essentially of $R_2T_{14}B$ and an R-poor auxiliary phase and are thus well resistant to corrosion.

The particles obtained by finely divided the permanent magnet material have M or M plus Ni on the surface, forming a corrosion resistant layer. Higher corrosion resistance is expected in this case. Since the M content on the particle surface can be higher than the average M content of the particles, little consideration is paid on rust prevention.

The bonded magnet of the invention has a high density of magnet material so that the advantages of the magnet material are fully utilized. The bonded magnet can be efficiently produced without inducing a crack.

EXAMPLES

In order that those skilled in the art will better understand the practice of the present invention, examples of the present invention are given below by way of illustration and not by way of limitation. In the Examples, v, A, B, and Ra/Rp are as defined below.

$v$ = volume ratio of auxiliary to primary phase $$A = \frac{v}{[0.1176(100 - z) - x]/x}$$

$$B = \frac{v}{(11.76 - x)/x}$$

$$Ra/Rp = \frac{R \text{ content of auxiliary phase}}{R \text{ content of the primary phase}}$$

EXAMPLE 1

An alloy having a composition: 10.5Nd-6B-3Zr-1Mn-bal.Fe (designated Composition 1, hereinafter, FIGURES represent atomic percents) was prepared by arc melting. A ribbon of 30 to 60 μm thick was formed from the alloy by melt spinning. More particularly, argon gas was applied to the molten alloy under a pressure of 0.2 to 2 kg/cm$^2$ to eject the melt through a quartz nozzle onto the surface of a chill roll rotating at a varying speed of from 10 to 30 m/sec. The melt was quenched and solidified in ribbon form. A series of samples were prepared as shown in Table 1.

The volume of auxiliary phase in each sample shown in Table 1 was controlled by varying a quenching parameter, that is, the rotational speed of the chill roll.

The magnetic properties of each sample measured are reported in Table 1.

Sample No. 3 in ribbon form was sectioned in a transverse direction. The fracture section was electrolytically polished and observed under a scanning electron microscope (SEM). FIGS. 2 and 3 are photomicrographs of magnification X50,000 and X200,000, respectively. The presence of an auxiliary phase is clearly observed in the photomicrographs.

SEM images were taken for the remaining samples. The average grain size of the primary phase and the average thickness of the grain boundary layer that the auxiliary phase formed were determined.

The results are shown in Table 1.

Figure 4:
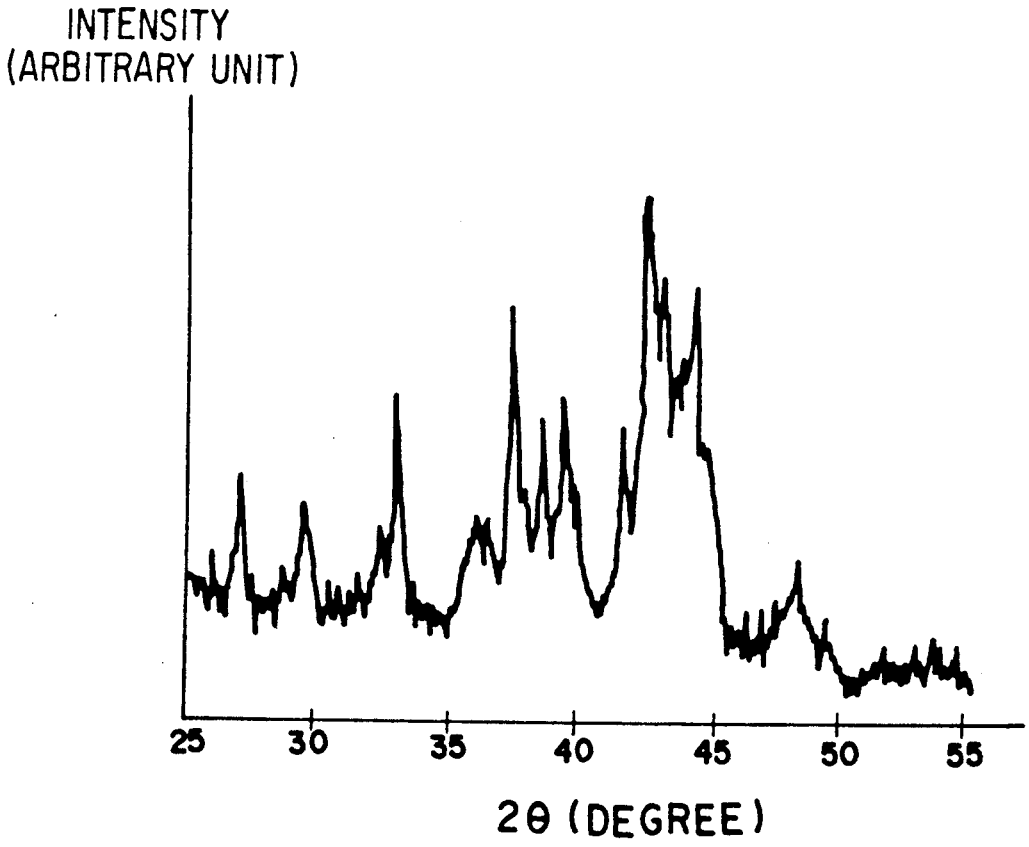
FIG. 4 is an X-ray diffraction diagram of permanent magnet sample No. 3 of Example 1.

Sample No. 3 was analyzed by X-ray diffractometry, with the result shown in FIG. 4. FIG. 4 indicates that the primary phase consists of $R_2Fe_{14}B$ and the auxiliary phase is amorphous.

The SEM images were subjected to image information processing to determine the volume of auxiliary phase, from which the auxiliary-to-primary phase volume ratio, v was calculated. The value of quotient A was calculated by dividing the auxiliary-to-primary phase ratio, v by the stoichiometric ratio given by the formula: $[0.1176(100-z)-x]/x$. The value of quotient B was calculated by dividing the auxiliary-to-primary phase ratio, v by $(11.76-x)/x$. The atomic ratio (Ra/Rp) of the R content (Ra) of the auxiliary phase to the R content (Rp) of the 5 primary phase is also calculated. The results are shown in Table 1.

For sample Nos. 2 and 4, the composition of the primary and auxiliary phases is shown in Table 2.

These measurements might also be made using a transmission type electron microscope for analysis.

TABLE 1

| Ribbon sample No. | Volume of auxiliary phase (vol %) | Br (KG) | iHc (kOe) | (BH) max (MGOe) | Average grain size of primary phase (μm) | Average thickness of grain boundary in auxiliary phase (μm) | Ra/Rp | A | B |
|---|---|---|---|---|---|---|---|---|---|
| | | | | 10.5Nd—6B—3Zr—1Mn—bal.Fe | | | | | |
| 1 | 2.4 | 8.2 | 13.5 | 13.0 | 0.32 | 0.001 | 0.48 | 0.32 | 0.20 |
| 2 | 3.5 | 8.3 | 13.2 | 13.6 | 0.18 | 0.002 | 0.51 | 0.48 | 0.30 |
| 3 | 5.5 | 8.3 | 13.3 | 14.2 | 0.06 | 0.003 | 0.56 | 0.78 | 0.49 |
| 4 | 6.5 | 8.2 | 13.0 | 14.0 | 0.05 | 0.005 | 0.62 | 0.92 | 0.58 |
| 5 | 28.5 | 7.5 | 6.0 | 7.0 | <0.02 | 0.010 | 1.05 | 5.30 | 3.32 |

TABLE 2

| Ribbon sample No. | Primary phase composition (at %) | Auxiliary phase composition (at %) |
|---|---|---|
| 2 | 10.8Nd—0.8Zr—0.1Mn—5.9B—balFe | 5.5Nd—25.3Zr—9.8Mn—7.4B—balFe |
| 4 | 11.0Nd—0.6Zr—0.1Mn—5.8B—balFe | 6.8Nd—45.5Zr—16.4Mn—8.3B—balFe |

TABLE 3

| Ribbon sample No. | Volume of auxiliary phase (vol %) | Br (KG) | iHc (kOe) | (BH) max (MGOe) | Average grain size of primary phase (μm) | Average thickness of grain boundary in auxiliary phase (μm) | Ra/Rp | A | B |
|---|---|---|---|---|---|---|---|---|---|
| 11 | 6.0 | 8.2 | 12.9 | 14.1 | 0.16 | 0.003 | 0.50 | 0.85 | 0.53 |
| 12 | 10.5 | 8.3 | 12.5 | 13.0 | 0.08 | 0.006 | 0.54 | 1.56 | 0.98 |
| 13 | 13.0 | 8.3 | 11.6 | 12.8 | 0.05 | 0.007 | 0.63 | 1.99 | 1.25 |

The samples were measured for magnetization by means of a vibrating magnetometer first after they were magnetized in a field of 18 kOe and then after they were magnetized in a pulsating field of 40 kOe. All the samples were found to be readily magnetizable.

EXAMPLE 2

An alloy having Composition 1 in Example 1 was prepared by arc melting. A ribbon of 30 to 60 μm thick was formed from the alloy by melt spinning. More particularly, argon gas was applied to the molten alloy under a pressure of 0.2 to 2 kg/cm$^2$ to eject the melt through a quartz nozzle onto the surface of a chill roll rotating at a varying speed of from 5 to 40 m/sec. The melt was quenched and solidified in ribbon form. A series of samples were prepared as shown in Table 3.

The volume of auxiliary phase in each sample shown in Table 3 was controlled by varying a quenching parameter, that is, the rotational speed of the chill roll.

The magnetic properties of each sample measured are reported in Table 3.

Sample No. 12 in ribbon form was sectioned in a transverse direction. The fracture section was electrolytically polished and observed under SEM. The presence of an auxiliary phase was clearly observed in the photomicrograph.

SEM images were taken for the remaining samples. The average grain size of the primary phase and the average thickness of the grain boundary layer that the auxiliary phase formed were determined.

The results are shown in Table 3.

Figure 6:
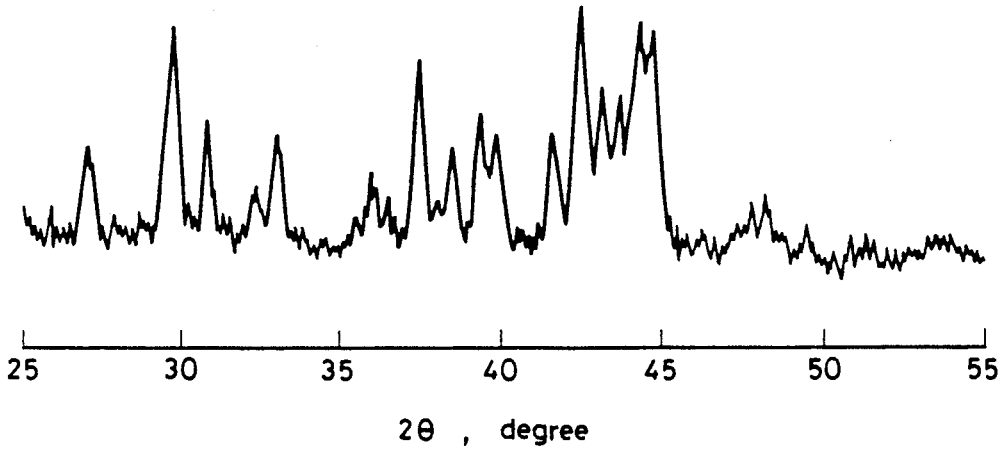
FIG. 6 is an X-ray diffraction diagram of permanent magnet sample No. 12 of Example 2.

Sample No. 12 was analyzed by X-ray diffractometry, with the result shown in FIG. 6. FIG. 6 indicates that the primary phase consists of $R_2Fe_{14}B$ and the auxiliary phase is amorphous.

The SEM images were subjected to image information processing to determine the volume of auxiliary phase, quotients A and B, and Ra/Rp ratio as defined in Example 1. The results are also shown in Table 3.

Measurements were taken using a transmission type analytic electron microscope.

EXAMPLE 3

Preparation of permanent magnet material ribbons

An alloy having an atomic composition: 9Nd-7.5B-2Zr-2Cr-4Ni-bal.Fe was prepared by arc melting. A ribbon of 30 to 60 μm thick was formed from the alloy by melt spinning. More particularly argon gas was applied to the molten alloy under a pressure of 0.2 to 2 kg/cm$^2$ to eject the melt through a quartz nozzle onto the surface of a chill roll rotating at a varying speed of from 5 to 30 m/sec. The melt was quenched and solidified in ribbon form. A series of samples were prepared as shown in Table 4.

The volume of auxiliary phase in each ribbon sample shown in Table 4 was controlled by varying a quenching parameter, that is, the rotational speed of the chill roll.

The magnetic properties of each ribbon sample measured are reported in Table 4.

Ribbon sample No. 21 was sectioned in a transverse direction. The fracture section was electrolytically polished and observed under SEM. The presence of an auxiliary phase was clearly observed in the photomicrograph.

SEM images were taken for the remaining samples. The average grain size of the primary phase and the average thickness of the grain boundary layer that the auxiliary phase formed were determined.

The results are shown in Table 4.

Figure 7:
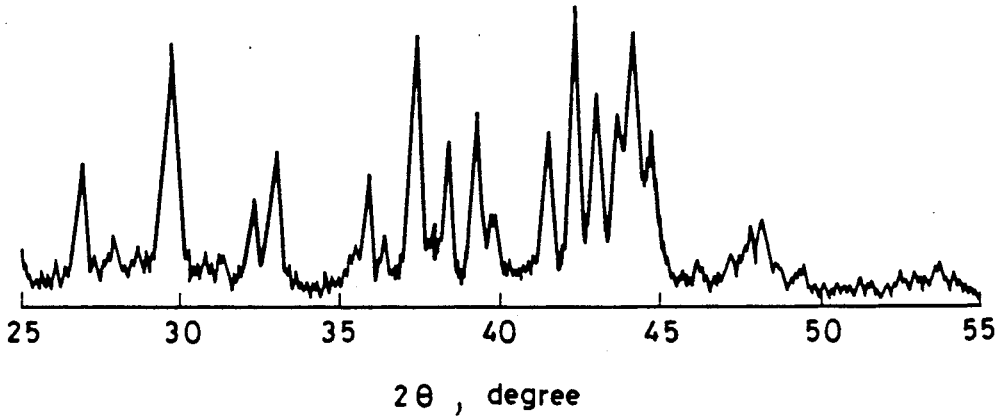
FIG. 7 is an X-ray diffraction diagram of permanent magnet sample No. 21 of Example 3.

Sample No. 21 was analyzed by X-ray diffractometry, with the result shown in FIG. 7. FIG. 7 indicates that the primary phase consists of $R_2Fe_{14}B$ and the auxiliary phase is amorphous.

The SEM images were subjected to image information processing to determine the volume of auxiliary phase, from which quotients A and B and Ra/Rp were calculated as in Example 1. The results are also shown in Table 4.

TABLE 4

| Ribbon sample No. | Roll rotating speed (m/sec) | Volume of auxiliary phase (vol %) | Br (KG) | iHc (kOe) | (BH) max (MGOe) | Average grain size of primary phase (μm) | Average thickness of grain boundary in auxiliary phase (μm) | Ra/Rp | A | B |
|---|---|---|---|---|---|---|---|---|---|---|
| 21 | 10 | 10.7 | 8.3 | 10.0 | 14.0 | 0.07 | 0.005 | 0.41 | 0.05 | 0.39 |
| 22 | 13 | 16.1 | 8.4 | 9.7 | 14.3 | 0.05 | 0.007 | 0.57 | 0.80 | 0.63 |
| 23 | 17 | 22.4 | 8.3 | 9.4 | 13.0 | 0.03 | 0.01 | 0.65 | 1.20 | 0.94 |
| 24* | 25 | 40.0 | 7.4 | 3.5 | 5.7 | <0.02 | 0.06 | 1.01 | 2.76 | 2.17 |

*Comparison

The samples in Table 4 were measured for magnetization by means of a vibrating magnetometer first after they were magnetized in a field of 18 kOe and then after they were magnetized in a pulsating field of 40 kOe. Sample Nos. 21–23 were found to be readily magnetizable.

Preparation of permanent magnet powder

Ribbon sample No. 22 was crushed in a stamp mill, obtaining permanent magnet powder sample No. 101 having a particle size of 50 to 200 μm.

Other permanent magnet powder sample Nos. 102–111 were prepared from alloys having a different composition as shown in Table 5 by following the same procedure as used for sample No. 101.

The samples were magnetized in a pulsating field of 40 kOe and stored for 500 hours at 60° C. and RH 90%. They were then observed for surface state with the eye.

The composition and surface state after 500-hour storage of these powder samples are reported in Table 5.

TABLE 5

| Permanent magnet powder sample No. | Composition (at %) | Surface state after storage |
|---|---|---|
| 101 | 9Nd—7B—3Zr—2Cr—7Ni—balFe | No rust |
| 102 | 9.4Nd—0.5Pr—6B—2Zr—2.5Cr—9Ni—balFe | No rust |
| 103 | 9.3Nd—7B—2Nb—1Cr—1Ti—1Hf—balFe | No rust |
| 104 | 7Nd—0.5Pr—0.5Ce—7.5B—3Nb—3Cr—5Ni—balFe | No rust |
| 105 | 7.9Nd—5Zr—13Ni—2Cr—5Co—8B—balFe | No rust |
| 106 | 6.5Nd—10Ni—4Zr—1Ta—2Cr—10B—balFe | No rust |
| 107 | 7Nd—1Hf—1W—2Nb—2Zr —7Ni—10B—balFe | No rust |
| 108 | 6Nd—0.5Pr—5Cr—1V—3Ni—11B—10Co—balFe | No rust |
| 109 | 10.3Nd—7B—3Cr—1Zr—1Nb—3Ni—8Co—balFe | No rust |
| 110 | 6.5Nd—6Cr—2Zr—10B—8Co—balFe | No rust |
| 111 | 6.5Nd—5Cr—2Zr—1Nb—0.5P—10.5B—10Co—balFe | No rust |

These permanent magnet particle samples were analyzed for composition by Auger electronspectroscopy while etching the sample surface. The M content of an area extending about 50 A from the particle surface was at least 1.5 times the average M content of the entire particle. The average M content was measured by fluorescent X-ray analysis, which value is in substantial agreement with the starting alloy composition.

The ratio Ra/Rp ranged from 0.2 to 0.70 for the samples shown in Table 5. Their quotient A had a value in the range of from 0.15 to 1.99 and quotient B had a value in the range of from 0.13 to 1.20.

Ribbon samples were prepared from the alloys having the composition shown in Table 5 while varying the volume of auxiliary phase as in the previous examples. These samples having a different auxiliary phase volume gave equivalent results to those reported in Table 5.

EXAMPLE 4

A ribbon of Composition 1 alloy in Example 1 was prepared by the same procedure as in Example 1 except that the rotating speed of the chill roll was set to 40 m/sec. The sample was found to have a quotient A of 1.45 and a quotient B of 0.91.

The sample was aged in an argon gas atmosphere at 600 to 700° C. for 1 hour. The aged sample was found to have a quotient A of 0.89 and a quotient B of 0.56.

The aged sample was determined for magnetic properties. The average grain size of the primary phase and the average thickness of the grain boundary layer that the auxiliary phase formed were determined. The results are shown below.

Br: 8.3 kG
iHc: 12.6 kOe
(BH)max: 14.1 MGOe
Primary phase average grain size: 0.07 μm
Auxiliary phase grain boundary thickness: 0.002 μm
Primary phase composition:

10.9Nd-0.8Zr-0.1Mn-5.8B-bal.Fe

Auxiliary phase composition:

6.3Nd-32.2Zr-12.9Mn-7.6B-bal.Fe

Ra/Rp=0.57

EXAMPLE 5

A series of samples as reported in Table 6 were prepared by the same procedure as in Example 1 except that the composition used was 8.5Nd-8B-2.5Nb-1Ni-10Co-bal.Fe. The rotating speed of the roll was varied from 7.5 to 25 m/sec.

As in Example 1, the samples were determined for magnetic properties, volume (in vol %) of auxiliary phase, quotients A and B, and Ra/Rp. The average grain size of the primary phase and the thickness of the grain boundary that the auxiliary phase formed were also determined. The results are shown in Table 6.

For sample Nos. 32 and 34, the composition of primary and auxiliary phases is shown in Table 7. under a pressure of 0.2 to 2 kg/cm2 to eject the melt through

TABLE 6

| Sample No. | Roll rotating speed (m/sec.) | Volume of auxiliary phase (vol %) | Br (KG) | iHc (kOe) | (BH) max (MGOe) | Average grain size of primary phase (μm) | Average thickness of grain boundary in auxiliary phase (μm) | Ra/Rp | A | B |
|---|---|---|---|---|---|---|---|---|---|---|
| 31 | 7.5 | 5.9 | 8.2 | 12.7 | 15.0 | 0.54 | 0.002 | 0.50 | 0.18 | 0.16 |
| 32 | 10 | 11.7 | 8.4 | 12.5 | 15.8 | 0.11 | 0.004 | 0.64 | 0.38 | 0.35 |
| 33 | 15 | 19.4 | 8.7 | 12.1 | 15.6 | 0.07 | 0.006 | 0.65 | 0.69 | 0.63 |
| 34 | 20 | 24.7 | 8.5 | 12.0 | 14.7 | 0.04 | 0.007 | 0.66 | 0.94 | 0.86 |
| 35* | 25 | 29.2 | 8.2 | 8.2 | 11.2 | <0.01 | 0.015 | 1.03 | 1.18 | 1.08 |

*comparison

TABLE 7

| Sample No. | Primary phase composition (at %) | Auxiliary phase composition (at %) |
|---|---|---|
| 32 | 8.8Nd—2.8Nb—0.2Ni—5.9B—balFe | 5.6Nd—0.3Nb—8.3Ni—19.8B—balFe |
| 34 | 9.1Nd—2.6Nb—0.1Ni—5.8B—balFe | 6.0Nd—2.1Nb—4.6Ni—16.8B—balFe |

EXAMPLE 6

Sample No. 3 of Example 1 was finely divided to particles having a size of about 100 μm. The powder was blended with a thermosetting resin and press molded into a bonded compact having a density of about 5.80 g/cc. The compact was magnetized in a pulsating field of 40 kOe. This bonded magnet is designated sample A.

Sample A was measured for magnetic properties, with the results shown below.

Br: 6.4 kG iHc: 12.8 kOe (BH)max: 8.5 MGOe

No difference was found between the bonded magnet and the ribbon magnet, sample No. 3 of Example 1 with respect to the average grain size of the primary phase, the thickness of the grain boundary that the auxiliary phase formed, quotients A and B, and Ra/Rp.

EXAMPLE 7

Stock materials were blended so as to produce an alloy having Composition 1 of Example 1. The blend was melted by RF heating. The melt was ejected in an argon atmosphere through a quartz nozzle onto the surface of a copper chill roll rotating at a circumferential speed of 30 m/sec., obtaining a ribbon of about 30 μm thick and about 5 mm wide. The ribbon was heat treated at 700° C. for 10 minutes. The heat treated ribbon is designated Sample B.

The heat treated ribbon was finely divided to particles having a size of about 50 to about 200 μm. The powder was hot pressed into a compact in an argon atmosphere at a temperature of about 700° C. under a pressure of 2,700 kg/cm$^2$ for 5 minutes. This compact is designated Sample C.

Samples B and C were measured for magnetic properties, with the results shown below.

| | Sample B | Sample C |
|---|---|---|
| Br (kG) | 8.3 | 8.1 |
| iHc (kOe) | 13.2 | 13.0 |
| (BH) max (MGOe) | 14.1 | 13.9 |

Samples B and C were measured for the average grain size of primary phase, the average thickness of the grain boundary that the auxiliary phase formed, quotients A and B, and Ra/Rp. The measurements were a grain size of 0.06 μm, a thickness of 0.002 μm, a quotient A of 0.80, a quotient B of 0.50, and an Ra/Rp ratio of 0.56 for both the samples. It was found that these values before crushing remained unchanged after crushing.

EXAMPLE 8

The procedure of Example 1 was repeated to prepare a series of samples having the composition shown in Table 8.

The samples were determined for magnetic properties by the same procedure as in Example 1. The results are shown in Table 8.

The composition of the primary and auxiliary phases of these samples is shown in Table 9.

TABLE 8

| Sample No. | Composition | Roll rotating speed (m/sec.) | Volume of auxiliary phase (vol %) | Br (KG) | iHc (kOe) |
|---|---|---|---|---|---|
| 41 | 10Nd—7B—2Zr—balFe | 20 | 10.8 | 8.5 | 12.3 |
| 42 | 9.5Nd—5B—2Nb—1Mn—balFe | 20 | 14.9 | 8.7 | 11.5 |
| 43 | 8.5Nd—6B—1Hf—1Zr—balFe | 15 | 19.5 | 8.9 | 11.7 |
| 44 | 8Nd—7B—2Cr—20Co—balFe | 15 | 24.8 | 9.0 | 10.9 |
| 45 | 8Nd—5B—2Zr—1Cu—balFe | 12.5 | 23.5 | 9.1 | 9.2 |
| 46 | 10Nd—7B—4Nb—balFe | 20 | 9.8 | 8.3 | 13.5 |
| 47 | 9Nd—7B—3Zr—1V—balFe | 15 | 16.7 | 8.4 | 14.1 |
| 48 | 9Nd—9B—3Ti—2Ni—balFe | 12.5 | 14.8 | 8.3 | 13.3 |
| 49 | 8Nd—8B—4Nb—1Mn—balFe | 10 | 24.8 | 8.2 | 13.6 |
| 50 | 8Nd—10B—5Zr—10Co—balFe | 10 | 20.7 | 8.4 | 13.1 |

| Sample No. | (BH) max (MGOe) | Average grain size of primary phase (μm) | Average thickness of grain boundary in auxiliary phase (μm) | Ra/Rp | A | B |
|---|---|---|---|---|---|---|
| 41 | 15.1 | 0.09 | 0.005 | 0.63 | 0.79 | 0.69 |
| 42 | 15.7 | 0.07 | 0.007 | 0.33 | 0.87 | 0.74 |
| 43 | 16.2 | 0.08 | 0.003 | 0.52 | 0.68 | 0.63 |
| 44 | 15.3 | 0.06 | 0.011 | 0.26 | 0.75 | 0.70 |
| 45 | 15.8 | 0.04 | 0.009 | 0.53 | 0.72 | 0.65 |

TABLE 8-continued

| | | | | | | |
|---|---|---|---|---|---|---|
| 46 | 14.3 | 0.07 | 0.005 | 0.43 | 0.84 | 0.62 |
| 47 | 15.8 | 0.05 | 0.007 | 0.56 | 0.79 | 0.65 |
| 48 | 14.9 | 0.04 | 0.008 | 0.55 | 0.65 | 0.57 |
| 49 | 14.7 | 0.05 | 0.006 | 0.07 | 0.83 | 0.70 |
| 50 | 14.3 | 0.05 | 0.010 | 0.38 | 0.66 | 0.56 |

TABLE 9

| Sample No. | Primary phase composition (at %) | Auxiliary phase composition (at %) |
|---|---|---|
| 41 | 10.6Nd—1.2Zr—5.8B—balFe | 6.7Nd—6.6Zr—13.3B—balFe |
| 42 | 10.4Nd—1.0Nb—0.2Mn—5.9B—balFe | 3.4Nd—7.9Nb—5.5Mn—12.8B—balFe |
| 43 | 9.4Nd—1.1Hf—1.2Zr—5.8B—balFe | 4.9Nd—0.3Hf—0.3Zr—6.5B—balFe |
| 44 | 9.3Nd—2.4Cr—5.8B—18.9Co—balFe | 2.4Nd—0.6Cr—11.5B—24.5Co—balFe |
| 45 | 8.8Nd—2.5Zr—0.4Cu—5.8B—balFe | 4.7Nd—0.1Zr—3.6Cu—1.5B—balFe |
| 46 | 10.6Nd—1.1Nb—5.9B—balFe | 4.6Nd—29.4Nb—17.1B—balFe |
| 47 | 9.5Nd—1.8Zr—0.6V—5.8B—balFe | 5.3Nd—7.1Zr—11.0V—17.6B—balFe |
| 48 | 9.3Nd—2.1Ti—0.4Ni—5.8B—balFe | 5.1Nd—12.3Ti—6.6Ni—37.1B—balFe |
| 49 | 8.8Nd—2.2Nb—0.7Mn—5.9B—balFe | 0.6Nd—10.3Nb—14.3Mn—20.5B—balFe |
| 50 | 8.9Nd—2.9Zr—5.8B—10.3Co—balFe | 3.4Nd—16.7Zr—33.3B—8.3Co—balFe |

EXAMPLE 9

A series of samples having Compositions D and E shown in Table 10 were prepared in the form of a ribbon having a thickness of 30 to 60 μm by single roll melt spinning with the rotating speed of a chill roll set to 15 m/sec.

The ribbon was heat treated in an argon atmosphere at a temperature of 700° C. for 30 minutes. It was then finely divided into particles having a size of about 20 to 400 μm. The powder was blended with a thermosetting resin and press molded into compacts having a varying density. Each of the bonded magnets was measured for (BH)max. The results are shown in Table 10.

TABLE 10

| Sample | D | E |
|---|---|---|
| Composition | 9.4Nd—7B—2.2Zr—10Co—balFe | 9Nd—0.5Pr—7B—3Nb—balFe |
| Quotient A | 0.72 | 0.75 |
| Quotient B | 0.64 | 0.63 |
| Primary phase | 10.2Nd—1.5Zr—5.8B—10.3Co—balFe | 9.6Nd—0.4Pr—1.8Nb—5.9B—balFe |
| Auxiliary phase | 1.0Nd—9Zr—18.3B—7.5Co—balFe | 4.5Nd—0.1Pr—15.5Nb—18.3B—balFe |
| $R_1/R_2$ | 0.10 | 0.47 |
| Density (g/cm$^3$) | 5.7 6.1 6.3 | 5.7 6.1 6.3 |
| (BH) max (MGOe) | 9.4 10.5 11.1 | 9.3 10.4 11.0 |

As seen from Table 10, the ribbon magnet of the present invention can be readily molded into a bonded magnet having a high density. Bonded magnets having a value of (BH)max of higher than 10 MGOe are obtained when the density exceeds 6 g/cm$^3$.

EXAMPLE 10

Ribbons having composition $(Nd_{(1-x)}, Zr_x)_{11}Fe_{82}B_8$ wherein x had a value of from 0 to 6 were prepared by the same procedure as in Example 1.

Figure 5:
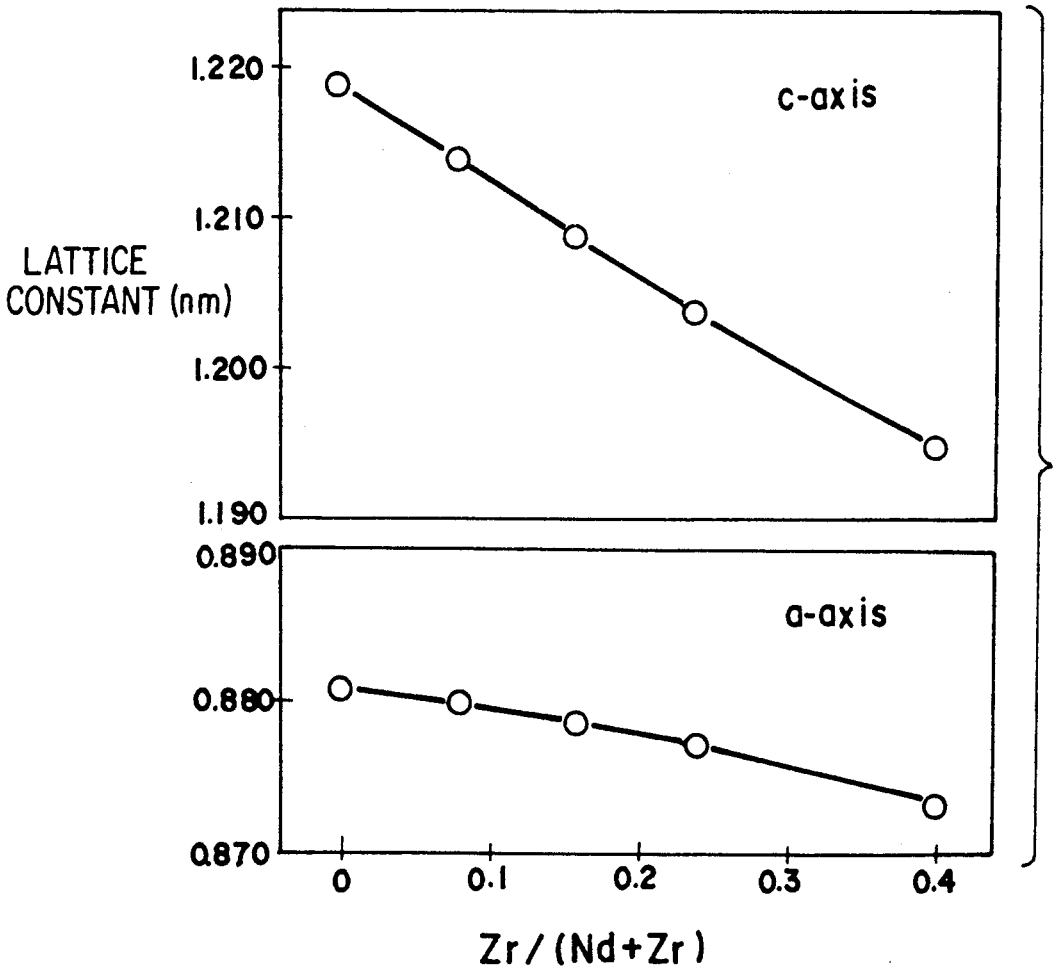
FIG. 5 is a diagram showing the lattice constant of a permanent magnet of Example 10 as a function of the composition of its primary phase.

The ribbons were analyzed by X-ray diffractometry. The lattice constants of the primary phase along a and c axes were determined from the diffraction pattern. The composition of the primary phase was determined by means of a transmission type analytic electron microscope. FIG. 5 shows the lattice constants as a function of Zr/(Nd+Zr) of the primary phase. As seen from FIG. 5, as many as 40% of the Nd sites of $Nd_2Fe_{14}B$ are replaced by Zr in the primary phase of the ribbon according to the present invention.

EXAMPLE 11

A series of samples having the following compositions were prepared by the same procedure as used in Composition 1 of Example 1 while varying the volume of the auxiliary phase. Equivalent results were obtained.

Composition (atomic percent)

10.5Nd-6B-3Nb-1Ti-bal.Fe
10Nd-0.5Pr-6B-2.5Zr-1V-bal.Fe
10.5Nd-5B-10Co-3Nb-1Ti-bal.Fe
10.5Nd-5B-1Ti-1Mo-bal.Fe
10.5Nd-5B-1Ti-1W-bal.Fe
10.5Nd-5B-1Ti-1Mo-7Co-bal.Fe
10.5Nd-5B-1Ti-1W-7Co-bal.Fe
11Nd-6B-2Nb-1Ni-bal.Fe
10.5Nd-6B-3Zr-0.5Cr-bal.Fe
0.5Nd-6B-3Zr-1Ti-10Co-bal.Fe
1Nd-1Pr-5B-3Zr-1Ti-bal.Fe
0.5Nd-6B-2.5Nb-1.5V-bal.Fe
0Nd-1La-5B-10Co-3Nb-1Ti-bal.Fe
1Nd-5.5B-2Ti-1Ni-bal.Fe
7.5Nd-8B-3Nb-1Ni-bal.Fe
Nd-7.5B-3Zr-1Cu-bal.Fe
Nd-7.5B-3Zr-1Mn-bal.Fe
Nd-7.5B-2.5Zr-1.5Cr-bal.Fe
Nd-8B-3Zr-1Ti-10Co-bal.Fe
7.5Nd-8B-3Zr-1Ti-10Co-bal.Fe
Nd-7B-2Hf-2V-bal.Fe
8.5Nd-8B-2.5Nb-1Zr-0.5Ag-bal.Fe
Nd-7B-2Zr-2Ti-10Co-bal.Fe
8.5Nd-8B-3Ti-1Cu-8Co-bal.Fe The samples were measured for magnetization by the same procedures as in Example 1. They were found to be readily magnetizable.

Obviously, numerous modifications and variations of the present invention are possible in light of the above teachings. It is therefore to be understood that within the scope of the appended claims, the invention may be practiced otherwise than as specifically described herein.

What is claimed is:

1. A permanent magnet material which is prepared by rapid quenching from a molten alloy having a composition represented by the formula:

$$R_xT_{(100-x-y-z-w)}B_yM_zNi_w$$

wherein R is at least one member selected from the rare earth elements including Y, T is Fe or a mixture of Fe and Co, M is at least one member selected from the group consisting of T, V, Cr, Zr, Nb, Hf, Ta and W, letters x,y,z, and w represent atom percents of the corresponding elements and have positive values with the proviso that w can be equal to zero, $5.5 \leqq x < 11.76$, $2 \leqq y < 15$, $0 < z \leqq 15$, and $0 < z+w \leqq 30$, and consisting essentially of a primary phase of substantially tetragonal grain structure and at least one auxiliary phase selected from amorphous and crystalline R-poor auxiliary phases, said auxiliary phase being present as a grain boundary layer, the atomic ratio of the R content of the auxiliary phase to that of the primary phase being up to 9/10.

2. The permanent magnet material of claim 1 wherein the quotient of the volume ratio of auxiliary phase to primary phase (v) divided by the value given by the formula: $[0.1176(100-z)-x]/x$ is up to 2.

3. The permanent magnet material of claim 2 wherein the quotient of the volume ratio of auxiliary phase to primary phase (v) divided by the value given by the formula: $[0.1176(100-z)-x]/x$ ranges from 1 to 2 and $z \leqq 10$.

4. The permanent magnet material of claim 2 wherein the quotient of the volume ratio of auxiliary phase to primary phase (v) divided by the value given by the formula: $[0.1176(100-z)-x]/x$ is less than unity.

5. The permanent magnet material of claim 2 wherein the quotient of the volume ratio of auxiliary phase to primary phase (v) divided by the value given by the formula: $[0.1176(100-z)-x]/x$ ranges from 0.15 to 0.95.

6. The permanent magnet material of claim 1 wherein the quotient of the volume ratio of auxiliary phase to primary phase (v) divided by the value given by the formula: $(11.76-x)/x$ is up to 2.

7. The permanent magnet material of claim 6 wherein the quotient of the volume ratio of auxiliary phase to primary phase (v) divided by the value given by the formula: $(11.76-x)/x$ is up to 1.

8. The permanent magnet material of claim 1 wherein $5.5 \leqq x \leqq 11$.

9. The permanent magnet material of claim 1 wherein the primary phase has an average grain size of from 0.01 to 3 μm.

10. The permanent magnet material of claim 1 wherein the auxiliary phase forms a grain boundary layer having an average breadth of up to 0.3 μm.

11. The permanent magnet material of claim 1 wherein the primary phase has an R content of from 6 to 11.76 atom %.

12. The permanent magnet material of claim 1 in the form of a ribbon which is prepared by rapid quenching.

13. The permanent magnet material of claim 1 in the form of powder.

14. The permanent magnet material of claim 2 which is obtained by rapid quenching from a molten alloy such that the quotient of the volume ratio of auxiliary phase to primary phase, v, divided by the value given by the formula: $[0.1176(100-z)-x]/x$ may range from more than 0 to 2.

15. The permanent magnet material of claim 2 which is obtained by rapid quenching from a molten alloy and then heat treating such that the quotient of the volume ratio of auxiliary phase to primary phase, v, divided by the value given by the formula: $[0.1176(100-z)-x]/x$ may range from more than 0 to 2.

16. The permanent magnet material of claim 1 wherein the permanent magnet material being comminuted into particles having M or M and Ni present on the surface thereof.

17. The permanent magnet material of claim 18 wherein the M content on the surface of particles is greater than the value of z for the entire material.

18. The permanent magnet material of claim 1 wherein B is partially replaced by P.

19. The permanent magnet material of claim 1 wherein M is a mixture of (a) at least one member selected from the group consisting of Ti, V, Cr, Zr, Nb, Mo, Hf, Ta and W and (b) at least one member selected from the group consisting of Cu, Mn and Ag.

20. A permanent magnet which is obtained by compacting the permanent magnet material of any one of claims 1 to 21 in powder form.

21. A permanent magnet which is obtained by hot plastic processing of the permanent magnet material of any one of claims 1 to 21 in powder form.

22. A permanent magnet comprising in admixture the permanent magnet material of any one of claims 1 to 21 in powder form and a binder.

* * * * *

UNITED STATES PATENT AND TRADEMARK OFFICE

CERTIFICATE OF CORRECTION

PATENT NO. : 5,022,939

DATED : JUNE 11, 1991

INVENTOR(S) : YAJIMA ET AL

It is certified that error appears in the above-identified patent and that said Letters Patent is hereby corrected as shown below:

Col. 23,

Claim 1, line 9, should read

--consisting of Ti, V, Cr, Zr, Nb, Mo, Hf, Ta and W,--.

Signed and Sealed this

Sixteenth Day of February, 1993

*Attest:*

STEPHEN G. KUNIN

*Attesting Officer*

*Acting Commissioner of Patents and Trademarks*